United States Patent [19]

Buck

[11] Patent Number: 4,623,291

[45] Date of Patent: Nov. 18, 1986

[54] PILING DEVICE FOR BOUND SETS OF SHEETS

[75] Inventor: Hermann Buck, Huelben, Fed. Rep. of Germany

[73] Assignee: Bielomatik Leuze GmbH, Fed. Rep. of Germany

[21] Appl. No.: 585,773

[22] Filed: Mar. 2, 1984

[30] Foreign Application Priority Data

Mar. 5, 1983 [DE] Fed. Rep. of Germany ..... 3307821

[51] Int. Cl.[4] ..... B65G 57/081

[52] U.S. Cl. ..... 414/31; 414/35; 414/85

[58] Field of Search ..... 414/31, 76, 80, 82, 414/85, 54, 55, 35, 30

[56] References Cited

U.S. PATENT DOCUMENTS

| | | | |
|---|---|---|---|
| 2,333,479 | 11/1943 | Graf | 414/80 |
| 2,918,852 | 12/1959 | Buccicone | 414/35 |
| 2,960,243 | 11/1960 | Beaulieu | 414/82 |
| 3,307,716 | 3/1967 | Ross | 414/35 |
| 3,447,695 | 6/1969 | Krepp et al. | 414/35 |
| 3,520,422 | 7/1970 | Bruce et al. | 414/82 |
| 4,369,015 | 1/1983 | Fabrig | 414/85 X |

FOREIGN PATENT DOCUMENTS

| | | |
|---|---|---|
| 38169 | 10/1981 | European Pat. Off. . |
| 1504913 | 9/1969 | Fed. Rep. of Germany . |
| 2443106 | 4/1975 | Fed. Rep. of Germany . |
| 2752372 | 6/1979 | Fed. Rep. of Germany . |

OTHER PUBLICATIONS

Spiral Binding Machine Type, p. 248, Bielomatik Leuze GmbH & Co., 1-1961.

*Primary Examiner*—Robert J. Spar
*Assistant Examiner*—Janice Krizek
*Attorney, Agent, or Firm*—Steele, Gould & Fried

[57] ABSTRACT

The device forms a pile with bindings projecting alternately on both sides from a pile core. In one embodiment, the blocks are guided in on a table transporter which can be led horizontally above a pile shaft to bring the block against a front support device constructed as a magnetic bar. With a forwardly lying ferromagnetic binding the magnetic bar holds this firmly while a block with a rear lying binding is again taken up and laid against a rear support device. The blocks are thrown down on to the pile by simultaneous releasing of the front and rear edges and guide themselves as they drop by means of the magnetic bars.

12 Claims, 4 Drawing Figures

PILING DEVICE FOR BOUND SETS OF SHEETS

BACKGROUND OF THE INVENTION

1. Field of the Invention

This invention relates to a device for piling bound sets of sheets in which a sequence of such sets are formed into a pile with their bindings offset from the core of the pile so the pile stays stable.

2. Prior Art

U.S. Pat. No. 4,369,015, Fabrig, whose disclosure of a book turning device is incorporated herein by reference, produces a series of bound sets of sheets, also denoted as blocks in the following text, with the bindings lying alternately in front and behind. Such devices have been known since the year 1961, and commercialised by bielomatik Leuze GmbH+Co. of 7442 Neuffen, West Germany, in their machine type P 248.

In the use of such a machine, the blocks, with their bindings lying alternately in front and behind, are fed to the region of the pile and a controllable stop ensures that the bindings, which are thicker than the thickness of the rest of the block, project out over the core of the pile. The term pile core denotes that part of the pile in which the actual sets of sheets without the bindings lie on top of one another. The pile core can be thought of as limited on both sides by a pile edge which is constituted by the joining line of the front edges, i.e. those edges lying opposite the binding, of alternate blocks in the pile. The controllable stop has the effect that the blocks, depending upon the position of the bound edge, are forwarded more or less further into the pile region before they are deposited on the block located below. This device is relatively complex. It requires the mechanical outlay for the movement of the controllable stop and additionally an electrical or electronic control means. A sinking pile table must be used because of the type of piling.

Nevertheless, such procedures must be undertaken since otherwise the bindings, the diameter of which is greater than the thickness of the block, would come to lie otherwise relative to the blocks lying below and above it and thereby would form a thicker, unwieldy and insecurely packed pile which would be in danger of toppling. Additionally, the bindings would mark the sheet sets during packing and transport and it could even happen, with pressure on the pile, that the bindings, for example spiral bindings, would distort.

SUMMARY OF THE INVENTION

It is a principal object of the invention to provide a piling device of the initially described type which is simply constructed and which works in functionally certain fashion.

It is a further object of the invention to provide a piling device for reliably and stably piling ring or spiral bound sheet sets.

In accordance with the invention a support device is arranged adjacent the pile, which cooperates with the binding, at least in the region of one pile edge, to ensure correct piling.

Such a device does not need to be controlled by extensive control measures in order to bring the block into one or the other position in each case. Rather the support device provides, by means of its cooperation with the binding, and not with the rest of the block, that the block automatically comes into the desired position, the binding then lying either in front of or behind the core of the pile. The support device can, for example, be a mechanical gripper which engages only the binding but not the block (which is thinner than the binding), or which otherwise cooperates with the binding, for example by engaging in a spiral or comb binding.

In a particularly preferred embodiment, however, the support device comprises at least one magnet which cooperates with ferromagnetic parts of the binding. Here, the actual positioning requires no mechanical outlay. The magnet operates automatically whether it is a question of the binding on the front edge or on the oppositely lying side.

The turning of the sets of sheets can be effected directly at the pile region, for example, during the falling down of a block on to the pile. In this connection the support devices can be effective in that in each case they pull the binding towards one or the other side and/or hold it thereon. In case of a device in which, as mentioned initially, the sets of sheets are fed to the pile region by a transporter in a transport direction with the binding lying alternately in front and behind, a support device can be arranged in the region of the pile front edge and a pulling back device can be provided which exerts on each pile of sheets after reaching the pile front edge a force acting counter to the transport direction. In this case, the block is pushed up to the furthest forward lying position and there the binding, if such is present, is held by the support device while the pulling back device runs back empty. If there is no binding at the front edge of the block, then it is pulled back by the return device. Advantageously, there can be provided in the region of the pile rear edge a working stop which can be let in and out of the transport path of the sheet piles, which then fixes the block in the drawn back position. Advantageously, support devices can also be arranged at the pile rear edge and their upper part can form the stop.

The magnetic support devices can be advantageously provided along the whole of the pile height and can have the form of vertical bars. In this case it is particularly easy to construct the piling device without a sinking table, so that the blocks, after their positioning on the one or other support device in the pile region, fall vertically downwards on to the pile which is forming. The support devices, along which the bindings slide, prevent the blocks from moving out of position as they fall downwardly. The floor of the piling device can be stationary with respect to its height. Preferably the support device arranged relative to at least one pile edge, particularly the pile front edge, can be movable to effect pile change. The pile can thus, for example, be pushed out in the longitudinal transport direction. In addition to this the support devices on the oppositely lying side can be arranged movably. However it is also possible to use special removers. Normally the magnetic force of the return is so adjusted that on the moving away of the support devices from the pile edge the blocks are not taken therewith. Should this, however, because of the type of the block (particularly light or easily sliding blocks) or the particular strength of the magnetic support devices, be not guaranteeable, then additionally at the outer pile edges there may be stops in addition to the magentic support devices, for example in the form of vertical bars, which are movable indpendently from the magnets. Accordingly first the magnets can be swung away, wherein the bars pevent the blocks being taken away at the same time. Thereafter the bars can be swung away to let the pile out. Also variable magnets, e.g. electromagnets, may be used.

The transporter effective in the pile region can be a carrier for the sets of sheets which can be introduced above the pile, which preferably has a slide stop which can be released downwards for the edge of the set of sheets. This sliding stop can be constructed so that it can be over-run, i.e. on the return of the carrier it automatically flops downwards in front of the next block and goes up again behind it. At the end of the transport path of the transporter there can be provided, in the region of the pile front edge, a holding device engaging the sets of sheets, preferably swingable in and out in dependence on the movement of the transporter. It constitutes a front support for the set of sheets while the transporter is fed back in reverse. When the return movement of the transporter releases the rear edge of the set of sheets, the holding device also releases the front edge so that the block can fall down essentially vertically without an inclination to tip. This inclination to tip can nevertheless in the case of an embodiment without a preceding turning device, also be used to turn the sets of sheets. In this case for example the movement of the holding device can be advanced or delayed with respect to the taking away of the transporter.

It is to be observed that by means of the invention a device is created for the formation of a pile with projecting binding edges which operates in a very simple and operationally certain fashion. In particular the working of the device is substantially independent of the sequence of the blocks arriving which in other devices gives rise to substantial requirements on control to sense the correct position of the blocks and the corresponding control of the stops is not necessary, since the properties of the blocks themselves determine what position it takes up. Should in one case a block be lacking or come in turned round position, then its binding is nevertheless deposited on the correct side, which within a pile can still be managed overall. Above all, however, the control is simple in that it can take place purely mechanically and all processes take place in the time of the arriving blocks and no stored control corresponding to a half period is necessary.

BRIEF DESCRIPTION OF THE DRAWINGS

Further advantages and features of the invention can be appreciated from the following description taken in connection with the accompanying drawings, wherein the features of the invention can be used individually or in combination with one another in advantageous embodiments of the invention. One exemplary embodiment of the invention is illustrated in the drawings and is described in more detail below.

DETAILED DESCRIPTION OF THE PREFERRED EMBODIMENTS

Figure 1:
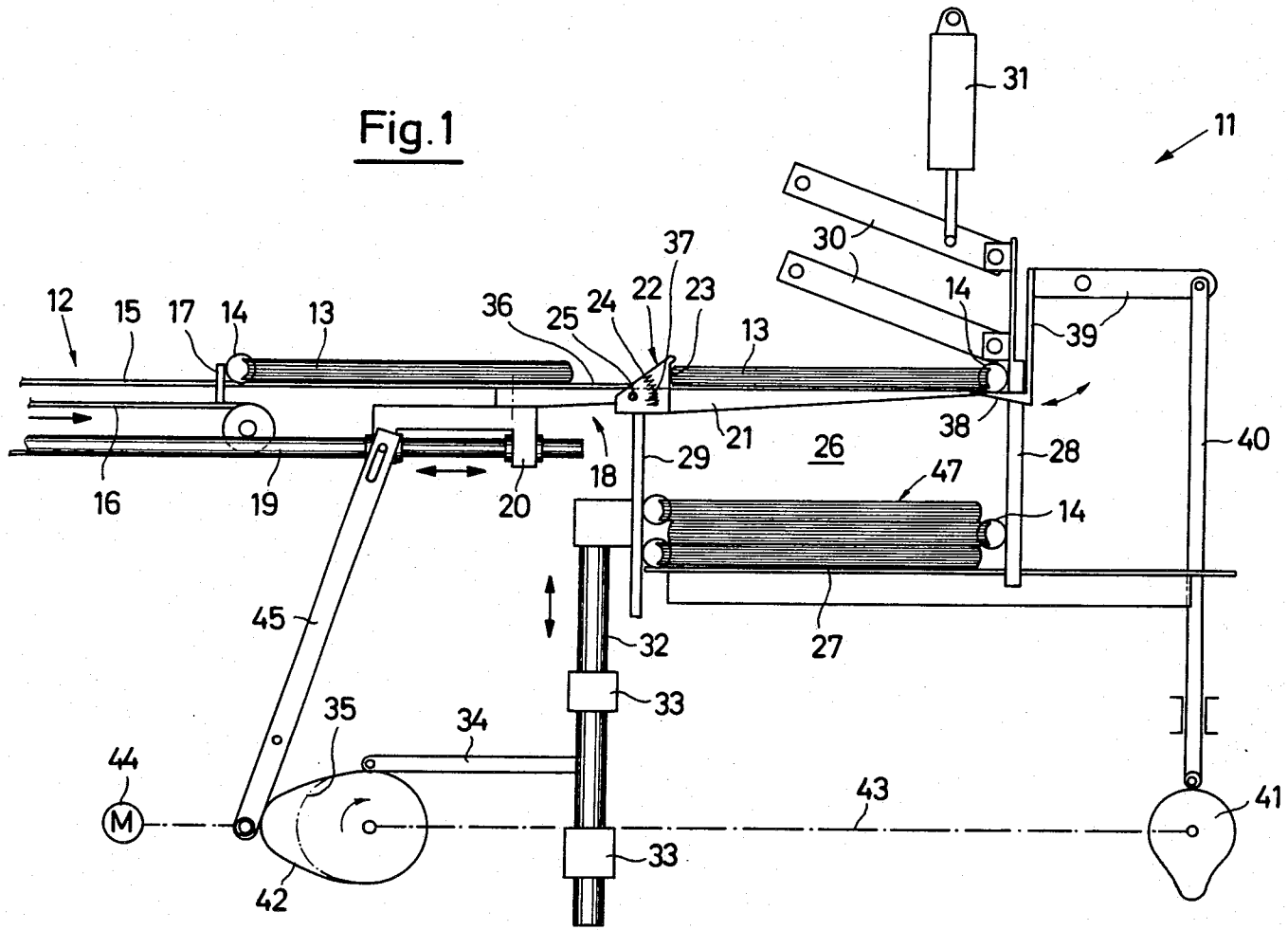
FIGS. 1 to 4 show schematic side views of a pile device in four different sequential working positions, the schematically illustrated drive mechanism is being shown only in FIG. 1.

The device illustrated in the drawings normally constitutes the final portion of a device for the manufacture of bound sets of sheets such as writing blocks etc. which are ruled, cut, piled, provided with cover sheets, punched and bound by machinery not forming a part of this invention. Also a previously arranged device which is known in the art for turning every second block through 180° is not illustrated.

A piling device 11 is fed by a feed conveyor 12 with a sequence of bound sets of sheets, which are denoted hereinafter as blocks 13, and which are transported forward in each case alternately with a front or rear lying binding 14. The binding 14 in the illustrated example is a so-called spiral binding in which an optionally plastics coated steel wire runs helically through bores adjacent the block back. However, other bindings can also be used in this connection, for example comb bindings from wire or sheet material, in which a comb-shaped pre-bent or stamped out strip is bent round substantially in the shape of a cylinder, wherein the prongs likewise engage in perforations of the block. The device illustrated is arranged for bindings which consist of ferromagnetic material or contain the same, i.e. bindings of steel or iron wire, which are by far the most common types of binding.

The infeed conveyor 12 consists of a chain or toothed belt conveyor 16 running below a transport table 15 with pusher dogs 17 fixed thereon.

Figure 2:
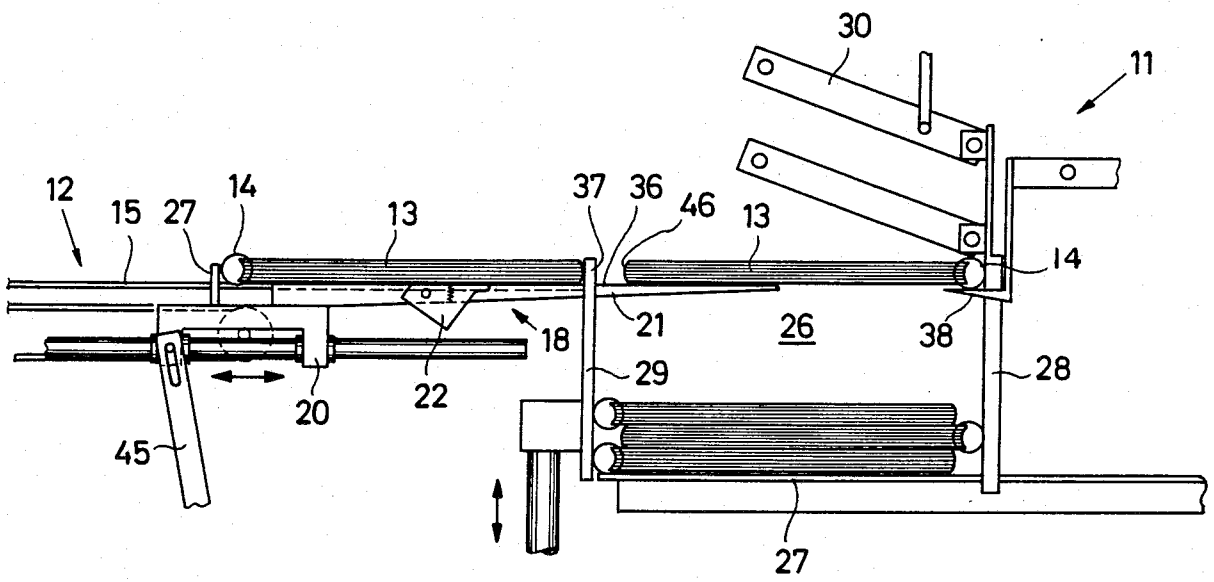

The infeed conveyor 12 ends in the position of the left-hand block 13 illustrated in FIG. 1. From there on the transport is taken over by a transporter 18 which has a slider 20 guided on a horizontal guide 19, on which carriers 21 projecting in the transport direction are arranged. On at least one of the carriers there is provided a pusher stop 22, which has in the transport direction an essentially vertical pushing surface 23 and in the opposite direction an oblique run on surface 24. It is mounted about a horizontal axis 25 resiliently in such fashion that normally it stands in the upwardly rotated position illustrated in FIG. 1, but as FIG. 2 shows, on pulling back the carrier, swings away under the sheet pile and accordingly can be run over.

The carriers 21 are constructed sufficiently long to take over a pile of sheets 13 from the infeed conveyor 12 and transport it up to a pile shaft 26 which is formed above a pile table 27 which is constructed as a fixed, i.e. not height adjustable, pile table consisting of rake-like bars. It is arranged more than the maximum pile height below the transport plane 21 and can be matched by adjustment to differing pile heights without however itself being necessarily capable of adjustment during the piling. The pile shaft is limited before and behind by support devices 28, 29, which are constructed as vertical bars, which consist of permanently magnetic material or which are provided with permanent magnets. In this connection individual magnets can be arranged on the bar or embedded in this or it is also possible to adhere strip-shaped magnetic strips on to the bars. In this connection the magnetic action of the support devices extends over the whole height of the pile shaft from somewhat above the transport plane up to the pile table. The front support device 28 is attached to a parallelogram guide 30, which can be swung by means of an actuation device 31, for example a pneumatic cylinder, so that the support device 28 can be swung away from the pile front edge and a finished pile of blocks fed out in the transport direction from the extended pile table.

The rear supporting device 29 consists likewise of magnetic bars and is movable in the vertical direction up and down along the rear edge of the pile. The device 29 is mounted on a column 32, guided vertically in guide mountings 33. An arm 34 fixed to column 32 runs via a follower on a cam 35, the contour of which is partially indicated by a dash-dot line. By the vertical movement, the support device 29 can be displaced with its upper edge alternately above and below the transport plane 36 of the carrier and accordingly constitute with its upper part a stop 37.

In the region of the pile front edge a support device 38 is provided which has holding fingers engaging through the support device 28 arranged in the form of bars, which fingers are at the height of the transport plane 36 and are so arranged on swingable arms 39 that they can be swung out from the pile shaft 26. In addition to this the rotating arms 39 are connected via a connecting rod 40 with a cam 41 which, in the same way as cam 35 and a drive cam 42 for the transporter 18, are turned by a drive shaft 43 common to the whole manufacturing machine for the blocks.

The slider 20 of the transporter 18 is driven movably horizontally to and fro by cam 42 via a two-armed lever 45.

The apparatus operates in the following manner.

FIG. 1 shows the position in which the transporter 18 has taken up block 13 with the binding 14 lying to the front into the most right-hand position with its carrier 21, wherein the sliding stop 22 has taken care that the block has been taken on to the table 15 and correctly positioned on the carrier. The front edge of the block with the binding is accordingly pushed over holding fingers of the holding device 38 and lies against the support device 28. The binding 14, consisting of steel wire, is attracted by the magnetic action to the support device 28.

If now, as FIG. 2 shows, the transporter 18 is pulled back towards the left, then the block 13 remains with its binding 14 at the front support device 28 and is there carried by the holding device 38 while the carrier 21 which is pulling back frees the central region of the block. In the meantime, controlled by cam 35, the rear support device 29 is moved upwardly so that its upper stop 37 projects above the transport plane 36. The stop 37 is, however, in this working cycle, ineffective because the front edge 46 opposite the binding lying to the rear of this block remains at a distance from the stop.

With the return movement the carriers 21 run into apertures in the transport table 15 and the sliding stop 22 tips as a result of its oblique running-on surface 24 under the next block 13 which is fed by the feed conveyor 12.

Figure 3:
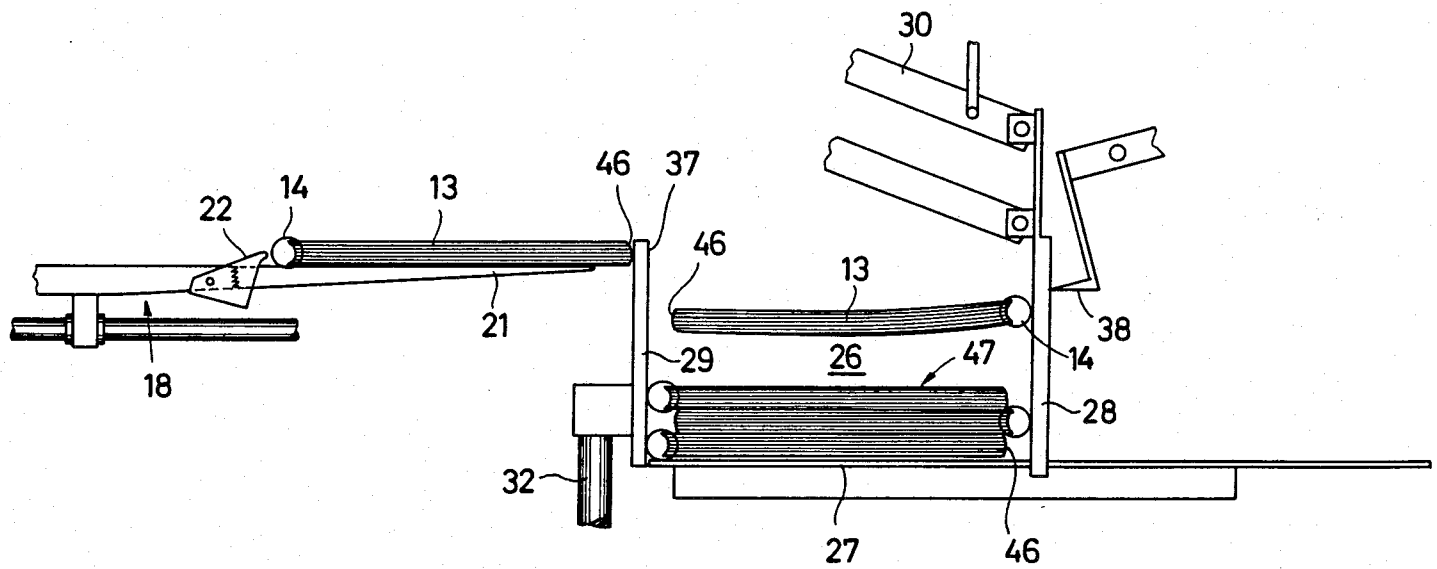

FIG. 3 shows the position in which the transporter 18 has reached its furthest left lying position, the sliding stop 22 comes free from the block 13, and by means of spring force come up again, and, principally, the front edge of the carriers 21 have run out from the pile shaft 26, wherein already somewhat previously the front edge 46 of the block 13 located in the pile region has been freed. Simultaneously, under control of the cam 41, the holding device 38 is swung out of the pile shaft so that also the binding side edge of the block is freed and now the block can fall in pile shaft 26 downwardly on to the pile 47 formed there. In this connection however the binding 14 is guided on the support device 28, so that the block 13 lands on the pile in the position provided for, namely in a position in which the binding 14 projects out from the pile core, which is limited by the connection line of the front edges 46 of every second block lying on top of one another. In order to effect this, the distance of the two pile outer edges i.e the distance between the support devices in the longitudinal direction of the pile is greater by the length region taken up by the binding than the corresponding dimension of the block.

From FIG. 3 it is furthermore evident that the stop 37 in the holding device 29 in the case of the transporter, which does not as illustrated in the drawing work with pusher dogs 17 but for example is constituted by a conveyor belt or the like, can also serve to position the blocks transported up in a particular position in which they are taken over from the carrier 21. Accordingly, in this case, the stop 37 is effective on both sides.

Figure 4:
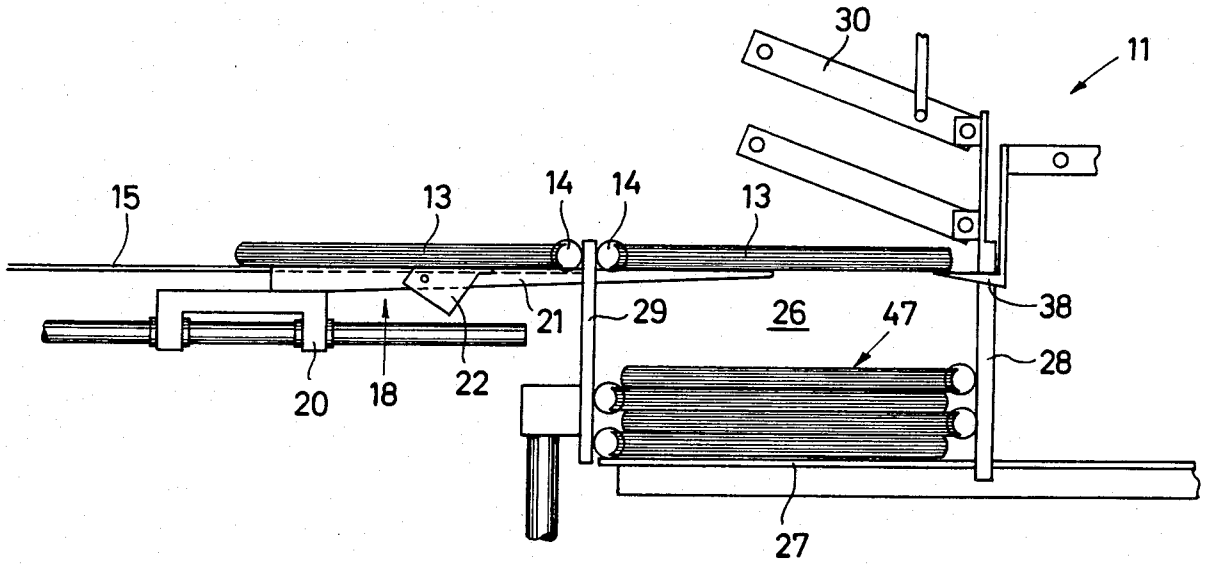

Finally in the position in accordance with FIG. 3 the support device 29 and accordingly the stop 37 are again guided below the transport plane 36, the holding device 38 is again swung in and the transporter 18 again moved to the right so that on its carriers 21 a new block 13 is led into the pile region, which now lies with its front edge 46 forwardly, while its binding 14 is behind. The position corresponding to FIG. 1 is not illustrated; it corresponds, apart from the 180° turned round position of the two upper blocks, in all the details to FIG. 1. Also this block is thus guided against the front support device 28, but, on account of the lack of ferromagnetic portions, it is not held there, so that on the rearward movement of the carrier 21 the block is also moved backwards therewith, until it abuts with its rearwardly lying binding 14 the stop 37 of the support device 29 which has been guided upwards again in the meantime. The force pulling back the block 13 is accordingly the frictional force of the block on the carriers 21. This position is shown in FIG. 4. The carrier is now moved out further from under the block, and in similar fashion as illustrated in FIG. 3, the block is freed from the carriers 21 and the holding device 38 so that it falls in the pile shaft 26 on to the pile 47. However in this case the binding 14 is held against the support device 29 and drops, guided by this, downwards. Thereafter the already described cycle repeats itself.

For changing the pile i.e. the removal of a finished form pile, by means of the action device 31 and parallelogram linkage 30, the front support device 28 is swung out and the pile moved out by a horizontal movement of the support device 29 or by means of special pushers (not illustrated) from the pile table in the transport direction.

In the case of the use of bindings without ferromagnetic parts, for example of plastics spirals or plastics comb bindings, the front support device 28 can be replaced by tongs which close only so far that a binding is grasped, but not however the block, which is thinner in constrast thereto. In addition on the front and rear edges of the pile only simple bars would be provided. The tongs could in this case also take over the function of the holding device. Since, however, in this case no guidance is guaranteed during the downward falling of the block, the pile height in this case should be limited or indeed one must provide a sinking pile table.

I claim:

1. A device for piling bound sets of sheets, each bound set having a binding edge and an opposite nonbound edge, in which successive bound sets of sheets are fed in a feeding direction to a piling position at a piling station at which the bound sets are to be lowered to form a pile with binding edges of successive bound sets of sheets lying alternately on opposite sides of the pile, each binding edge projecting beyond the nonbound edge of an adjacent set of sheets in the pile, the device comprising:

a transporter operative to feed the bound sets of sheets to the piling station;

a retaining device for selectively retaining only binding edges that are oriented toward the retaining device, the retaining device being arranged at the piling position in the vicinity of a one pile side at which the binding edges are to be aligned when piled at the piling station, the retaining device retaining each binding edge arriving at said one pile side, the retaining device being unable to retain non-bound edges arriving at said one pile side, the retaining device selectively holding the binding edge of only those sets of sheets having binding edges projecting on said one pile side; and, a pulling back device operative to urge each of said bound sets of sheets in a pulling back direction away from said one pile side, the retaining device aligning said bound sheets at said one pile side and the pulling back device displacing ones of said bound sets of sheets that are not retained, toward an opposite pile side as the sets of sheets are formed into a pile.

2. The device of claim 1, adapted for use with bindings having ferromagnetic portions, the retaining device comprising at least one retaining magnet cooperating with the ferromagnetic portions of the binding.

3. The device of claim 1, in which the bound sets of sheets are fed with front edges foremost in a transporter feeding direction to the piling station by the transporter with the binding edges lying alternately at the front edge and at the opposite rear edge in said feeding direction, the retaining device being adapted for retaining only the binding edges positioned at a front side of the pile when in an aligned position and being disposed in the vicinity of the pile front side; and, the pulling back device exerting a force on each bound set of sheets acting counter to the feed transport direction and counter to a retaining force exerted by the retaining device after the bound sets of sheets reach the pile front side.

4. The device of claim 3, further comprising a stop member for each bound set of sheets, in the vicinity of a pile rear side; and, means for moving said stop member in and out of the feed transport path of the bound set of sheets.

5. The device of claim 4, further comprising a support device for retaining only the rear binding edges in a corresponding aligned position, disposed at the pile rear side.

6. The device of claim 2, comprising magnetic retaining devices along the whole pile height.

7. The device of claim 1, comprising a pile table of fixed height for receiving bound sets in a piling operation, the retaining device being movable between a pile side guiding position and a pile removable position.

8. The device of claim 1, further comprising a support device disposed at the pile rear side, horizontally movable to enable the formed piles to be slideably removed.

9. The device of claim 3, wherein the pulling back device for the bound sets of sheets can be introduced above the pile; and further comprising a retractable sliding stop carried by the pulling back device and adapted to engage the rear edge of the bound set of sheets.

10. The device of claim 3, wherein said transporter is movable to an end of a forward transport path, and further comprising a support member disposed at the end of the forward transport path of the transporter, in the vicinity of the pile front side, and a holding device engaging under the front edge of each bound set of sheets; and, means for moving the support member in and out of the piling station in dependence on the movement of the transporter.

11. The device of claim 5, wherein an upper portion of the support device forms the stop member.

12. The device of claim 2, further comprising magnetic retaining devices provided along the whole pile height having the shape of vertical bars.

* * * * *